US011399620B2

(12) United States Patent
Shtriker

(10) Patent No.: US 11,399,620 B2
(45) Date of Patent: Aug. 2, 2022

(54) CONNECTOR

(71) Applicant: MAROM DOLPHIN LTD, Afula (IL)

(72) Inventor: Yehonatan Shtriker, Kiryat Tivon (IL)

(73) Assignee: Marom Dolphin Ltd., Afula (IL)

( * ) Notice: Subject to any disclaimer, the term of this patent is extended or adjusted under 35 U.S.C. 154(b) by 0 days.

(21) Appl. No.: 16/321,307

(22) PCT Filed: Jul. 28, 2017

(86) PCT No.: PCT/IL2017/050841
§ 371 (c)(1),
(2) Date: Jan. 28, 2019

(87) PCT Pub. No.: WO2018/020502
PCT Pub. Date: Feb. 1, 2018

(65) Prior Publication Data

US 2019/0174901 A1 Jun. 13, 2019

(30) Foreign Application Priority Data

Jul. 28, 2016 (IL) ..... 247012

(51) Int. Cl.
*A45F 3/14* (2006.01)
*A45F 5/02* (2006.01)
*A45F 3/00* (2006.01)

(52) U.S. Cl.
CPC ..... *A45F 3/14* (2013.01); *A45F 3/005* (2013.01); *A45F 5/021* (2013.01); *A45F 2003/142* (2013.01); *A45F 2003/146* (2013.01)

(58) Field of Classification Search
CPC .. A45F 3/14; A45F 3/005; A45F 5/021; F16B 21/086; F16B 1/0014
USPC ..... 224/257; 24/603
See application file for complete search history.

(56) References Cited

U.S. PATENT DOCUMENTS 1,265,869 A 5/1918 Arkin
4,526,298 A * 7/1985 Boxer ..... A45F 3/16 222/529
5,609,278 A * 3/1997 Fresco ..... A45F 3/04 224/153
5,732,867 A * 3/1998 Perkins ..... A45F 3/08 224/628
5,850,996 A * 12/1998 Liang ..... A45F 5/02 248/221.11
5,954,250 A * 9/1999 Hall ..... A62B 25/00 224/629
6,330,736 B1 * 12/2001 Cheng ..... A45C 13/30 24/658
7,624,484 B2 * 12/2009 Lundh ..... A44B 11/258 24/627
8,006,877 B2 * 8/2011 Lowry ..... A45F 3/04 224/660
8,312,600 B2 * 11/2012 Colorado ..... A62B 25/00 24/657

(Continued)

*Primary Examiner* — Nathan J Newhouse
*Assistant Examiner* — Lester L Vanterpool
(74) *Attorney, Agent, or Firm* — William H. Dippert; Laurence A. Greenberg; Werner H. Stemer

(57) ABSTRACT

A connector is disclosed for fastening and dismantling a load to or from, respectively, a belt that can be worn by a carrier that comprises a buckle male configured for swift fastening the load to the belt and a buckle configured for swift dismantling the load from the belt using one hand of the carrier.

11 Claims, 9 Drawing Sheets

(56) References Cited

U.S. PATENT DOCUMENTS

| | | | | |
|---|---|---|---|---|
| 8,545,144 | B2 * | 10/2013 | Kim | B28D 1/143 409/201 |
| 8,714,424 | B2 * | 5/2014 | Oddou | A45F 3/04 224/637 |
| 8,740,028 | B2 * | 6/2014 | Hairston | A45F 3/10 224/636 |
| 8,857,681 | B2 * | 10/2014 | Burnett | A44B 11/005 24/3.1 |
| 9,220,333 | B2 * | 12/2015 | Losos | A45F 3/10 |
| 9,545,144 | B2 * | 1/2017 | Gill | A45F 3/14 |
| 9,636,875 | B2 * | 5/2017 | Hairston | A45F 3/047 |
| 10,004,320 | B2 * | 6/2018 | Reid | A45F 3/047 |
| 10,137,319 | B2 * | 11/2018 | Carr | A45F 3/10 |
| 10,383,426 | B2 * | 8/2019 | Rittenhouse | A45F 3/10 |
| 10,569,108 | B2 * | 2/2020 | Farnaby | A45F 3/08 |
| 10,667,599 | B2 * | 6/2020 | Shtriker | A45F 3/08 |
| 2005/0111906 | A1 | 5/2005 | Liou et al. | |
| 2007/0107169 | A1 * | 5/2007 | Kung | A44B 11/258 24/308 |
| 2009/0173763 | A1 * | 7/2009 | Bridgeman | A45F 3/047 224/674 |
| 2010/0011548 | A1 * | 1/2010 | Rudduck | F16B 21/183 24/604 |
| 2010/0243693 | A1 * | 9/2010 | Terry | A45F 3/08 224/633 |
| 2013/0232742 | A1 | 9/2013 | Burnett et al. | |
| 2014/0130316 | A1 * | 5/2014 | Rudduck | E05B 47/06 24/604 |
| 2014/0151424 | A1 * | 6/2014 | Hexels | F41H 1/02 224/637 |
| 2014/0339232 | A1 | 11/2014 | Fiedler | |
| 2017/0234350 | A1 * | 8/2017 | Rudduck | F16B 21/086 24/603 |

* cited by examiner

CONNECTOR

CROSS-REFERENCE TO RELATED APPLICATIONS

The present application is a National Phase filing under 35 U.S.C. § 371 of International Patent Application No. PCT/IL2017/050841, filed Jul. 28, 2017, which is based upon and claims the benefit of the priority date of Israeli Patent Application No. 247012, filed Jul. 28, 2016, each of which is expressly incorporated herein by reference in its entirety.

TECHNICAL FIELD

The present disclosed subject matter relates to a load harnessed to humans. More particularly, the present disclosed subject matter relates to rapid release of the load.

BACKGROUND

The equipment carried by today's infantryman is so bulky and heavy that it presents a significant burden and impairment to his/her performance, both when training and on operations. The problem of an excessive equipment burden is widely recognized within the defense forces around the world and significant effort has gone in to addressing it, from such diverse fields as equipment design, soldier training, logistics chain and robotics. Despite this effort, the infantryman is still required to carry weights often greater than 50 kg for significant distances.

In principal an infantryman's load may divided into two assets, personal gear and team assets (platoon, company, or the like). The content of the personal gear includes standard required equipment as outlined each unit's standard operational procedures, as well as personal rations and 'morale' items. Typically, the personal gear consists of, uniform, boots, combat body armor, helmet, weapon and a tac-vest that comprise: magazines, grenades, weapon accessories, water, vitamins, energy bars, basic communication device, night vision accessory, first-aid etc.

With such personal gear (as described above) infantryman's can maintain a great deal of mobility, and agility while participating in action, yet long term surviving of a group of soldier without additional logistics becomes an issue. Usually soldiers must also carry additional team assets, such as, radios, batteries, mines, medical supply, ammunitions, explosives, food, stretcher, variety of military items, a combination thereof, or the like. These items/assets are usually packed into large backpacks, where each backpack can weigh up to 50 kg. The soldier harnesses the backpack on the shoulders and secures it around the waist while performing rigorous physical and mental tasks.

Despite all the work to date no single effective solution to ease the load burden of the infantryman has arisen. There are solutions, but they are many. In and of itself each solution may have only a small impact, but taken together they can combine to lift the load burden off the soldier's shoulders. The problem of load burden is not restricted to soldiers; firefighters safety may be impacted due to equipment load burden; as well as any duty that involves emergency situations.

The disclosed subject matter is focused on solution approach based expressing the soldier load burden in terms of work equation: work done=force×distance, while, power is expressed in the equation: power=work done/time taken to do the work. Where, the force is equal the weight of the soldier together all his/her gear. Clearly, not all the soldier activities requires all the team assets all the time, thus soldiers may be alleviated of the load burden for period of times that are dictated by the standard operational procedures.

SUMMARY

According to a first aspect of the present disclosed subject matter, a connector for fastening and dismantling a load to or from, respectively, a belt that can be worn by a carrier comprising:

a buckle male configured for swift fastening the load to the belt; and a buckle configured for swift dismantling the load from the belt using one hand of the carrier.

In some exemplary embodiments, the load is selected from a group comprising: a backpack; a rucksack; a cart; and a sled.

In some exemplary embodiments, the buckle male is assembled to a load and the buckle is assembled to the belt.

In some exemplary embodiments, the belt is selected from a group comprising: a lumbar-belt; a tac-vest; a back-belt; a weightlifting-belt; and a firefighters-belt.

In some exemplary embodiments, the buckle is assembled to the load and the buckle male is assembled to the belt.

In some exemplary embodiments, the connector is connected by swift pushing the buckle and the buckle male one into the other.

In some exemplary embodiments, the buckle male comprises a groove and the buckle comprises two latches configured to enter the groove and grasp the buckle male so as to establish a firm connection.

In some exemplary embodiments, a single release cord is connected to both latches to enable swift dismantling the load by pulling the single release cord that consequently causes the latches to egress the groove, thus releasing the firm connection.

In some exemplary embodiments, the buckle male comprises a circular groove and the buckle comprises two latches, each having a half circle shape arm, and wherein said connector is connected when the two latches enter the circular groove and grasp the buckle male.

In some exemplary embodiments, the connector is disconnected when the two latches exit the circular groove of the buckle male.

In some exemplary embodiments, the buckle male is configured to freely rotate inside the buckle, and wherein the rotation allows the load to sway about the belt.

In some exemplary embodiments, the rotation of the buckle male inside the buckle is limited.

In some exemplary embodiments, the rotation is limited to vary between 10 to 40 degrees on either side of a vertical axis of the carrier when he is standing straight.

In some exemplary embodiments, the buckle male further comprises a circular barrier.

In accordance with another aspect of the subject matter, a load system is provided that comprises:

a belt provided with an integral buckle;

a plurality of loads, each provided with an integral buckle male, wherein said buckle and said buckle male constitute a connector, and wherein a carrier wearing said belt can swiftly replace the loads by connecting a connector made of buckle male of one of said plurality of loads, disconnecting the connector, and connecting another load.

In some exemplary embodiments, the belt is selected from a group comprising: a lumbar-belt; a tac-vest; a back-belt; a waist-belt; and a firefighters-belt.

In some exemplary embodiments, the load is selected from a group comprising: a backpack; a rucksack; a cart; a sled; and a combination thereof.

In accordance with yet another aspect, a connector for securing a load to a belt is provided that comprises:

- a buckle attached to the belt wherein the buckle is provided with at least two latches;
- a buckle male attached to the load wherein the buckle male comprises a bolt and wherein the connector is secured when the bolt is grasped by the latches;
- a cord connected to said at least two latches wherein pull of said cord causes the at least two latches to release their grasp for disconnecting the connector.

In some exemplary embodiments, the load is selected from a group comprising: a backpack; a rucksack; a cart; a sled; and a combination thereof.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the Drawings.

DETAILED DESCRIPTION

Figure 1:
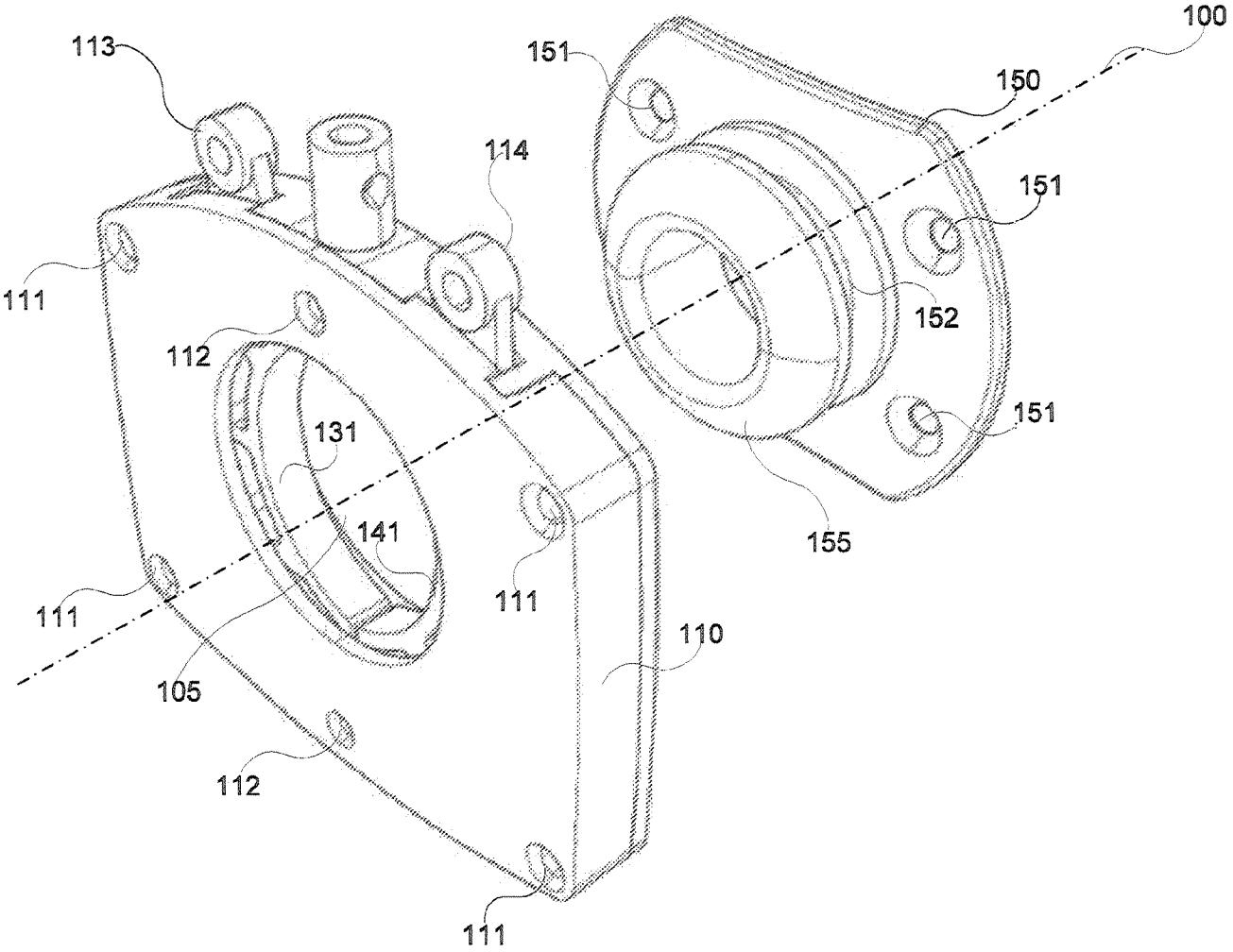
FIG. 1 illustrates a perspective view of a buckle and a perspective view of a buckle male, in accordance with some exemplary embodiments of the disclosed subject matter.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The terms "comprises", "comprising", "includes", "including", and "having" together with their conjugates mean "including but not limited to". The term "consisting of" has the same meaning as "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this disclosed subject matter may be presented in a range format. It should be understood that the description in range format is merely for convenience and brevity and should not be construed as an inflexible limitation on the scope of the disclosed subject matter. Accordingly, the description of a range should be considered to have specifically disclosed all the possible sub-ranges as well as individual numerical values within that range.

It is appreciated that certain features of the disclosed subject matter, which are, for clarity, described in the context of separate embodiments, may also be provided in combination in a single embodiment. Conversely, various features of the disclosed subject matter, which are, for brevity, described in the context of a single embodiment, may also be provided separately or in any suitable sub-combination or as suitable in any other described embodiment of the disclosed subject matter. Certain features described in the context of various embodiments are not to be considered essential features of those embodiments, unless the embodiment is inoperative without those elements.

One problem dealt with by the disclosed subject matter is securing a load to a human carrier and preventing the load from moving (e.g. tilting, flipping and shifting) while the human carrier is in motion. As an example, a load carried by a human in motion may be; a backpack, rucksack, self contain breathing apparatus (SCBA) backpack, a combination thereof, or the like; carried on the shoulders soldier or rescue workers.

Another problem dealt with by the disclosed subject matter is harnessing a load to a human or an animal, such as a dog, for towing military cart and ice/snow sleds.

Yet another problem dealt with by the disclosed subject matter is enabling a swift and reliable release of the load in case of emergency or whenever is needed.

One technical solution is providing the carrier with fastening apparatus that enables swift connecting and securing the load to the carrier without impairing the maneuverability of the carrier.

Another technical solution is providing the carrier with fastening apparatus that enables swift dismantling, with one hand only, the load from the carrier whenever it's needed.

One technical effect of utilizing the disclosed subject matter is securing the load to the carrier and preventing the load from moving or shifting while the carrier is in motion. For example, helping soldiers and firefighters maintain a great deal of mobility and agility, while participating in action.

Another technical effect of utilizing the disclosed subject matter is facilitating carriers with the ability of quickly alleviating themselves from the load burden when it's mostly needed.

Referring now to FIG. 1, illustrating perspective views of buckle 110 and buckle male 150, in accordance with some exemplary embodiments of the disclosed subject matter.

In some preferred embodiments, buckle 110 may be associated with the carrier, such as carrier 401 (depicted in FIGS. 4A through 4F), and buckle male 150 maybe associated with the load such as load 402 (depicted in FIGS. 4A through 4F). However, such association is not mandatory and in other exemplary embodiments, the association may be reversed. It will be noted that for the sake of simplification, the following text, describing the disclosed subject matter, focuses on embodiments associating buckle 110 with the carrier and buckle male 150 with the load.

It shall be noted that the term "load", such as load 402, refers in the present disclosed subject matter to a package having items, such as, backpack, rucksack, SCBA backpack, radio backpack, carts, sleds, a combination thereof, or the like.

It shall be noted that the term "swift release" refers in the present disclosed subject matter to a speedy operation of dismantling the carrier, such as carrier 401, from the load. Swift release may be required in emergency situations, where the carrier must be alleviated of the load to gain better maneuverability and agility.

In some exemplary embodiments of the disclosed subject matter, buckle male 150 may be an integral part of the load, typically mounted on the bottom section of a load. Alternatively, buckle male 150 may be connected to the load by bolts, rivets, a combination thereof, or the like. Buckle mounting holes 151 may be used for bolting or riveting the buckle male 150 to the load.

In some exemplary embodiments, buckle 110 may be an integral part of a carrier's belt, wherein the buckle 110 typically mounted at the back (i.e. near the lower back of the carrier). In some exemplary embodiments, a carrier's belt (belt), such as belt 403 (depicted in FIGS. 4A through 4A) may be a waist-belt, lumbar-belt; a tac-vest; a back-belt; a weightlifting-belt; and a firefighters-belt; a combination thereof, or the like. Buckle 110 may be connected to belt 403 by bolts, rivets, a combination thereof, or the like. Buckle mounting holes 111 may be used for bolting or riveting the buckle 110 to belt 403.

In some exemplary embodiments, buckle 110 and buckle male 150 may be connected by driving bolt 155 of buckle male 150 into receptacle 105 of buckle 110 along axis 100. While driving bolt 155 into receptacle 105 a $1^{st}$ latch 131 and a $2^{nd}$ latch 141 (both having half circle shape) are spread (open) sideways, against a spring (not shown) force, which normally keeps them in a close position. Upon the $1^{st}$ latch 131 and $2^{nd}$ latch 141 spreading sideways, bolt 155 can fully penetrate into receptacle 105. Once bolt 155 gets all the way in, both $1^{st}$ latch 131 and $2^{nd}$ latch 141 can return to close position inside groove 152, thus locking buckle 110 and buckle male 150 together by hugging the entire circumference of bolt 155 with $1^{st}$ latch 131 and $2^{nd}$ latch 141.

Figure 2:
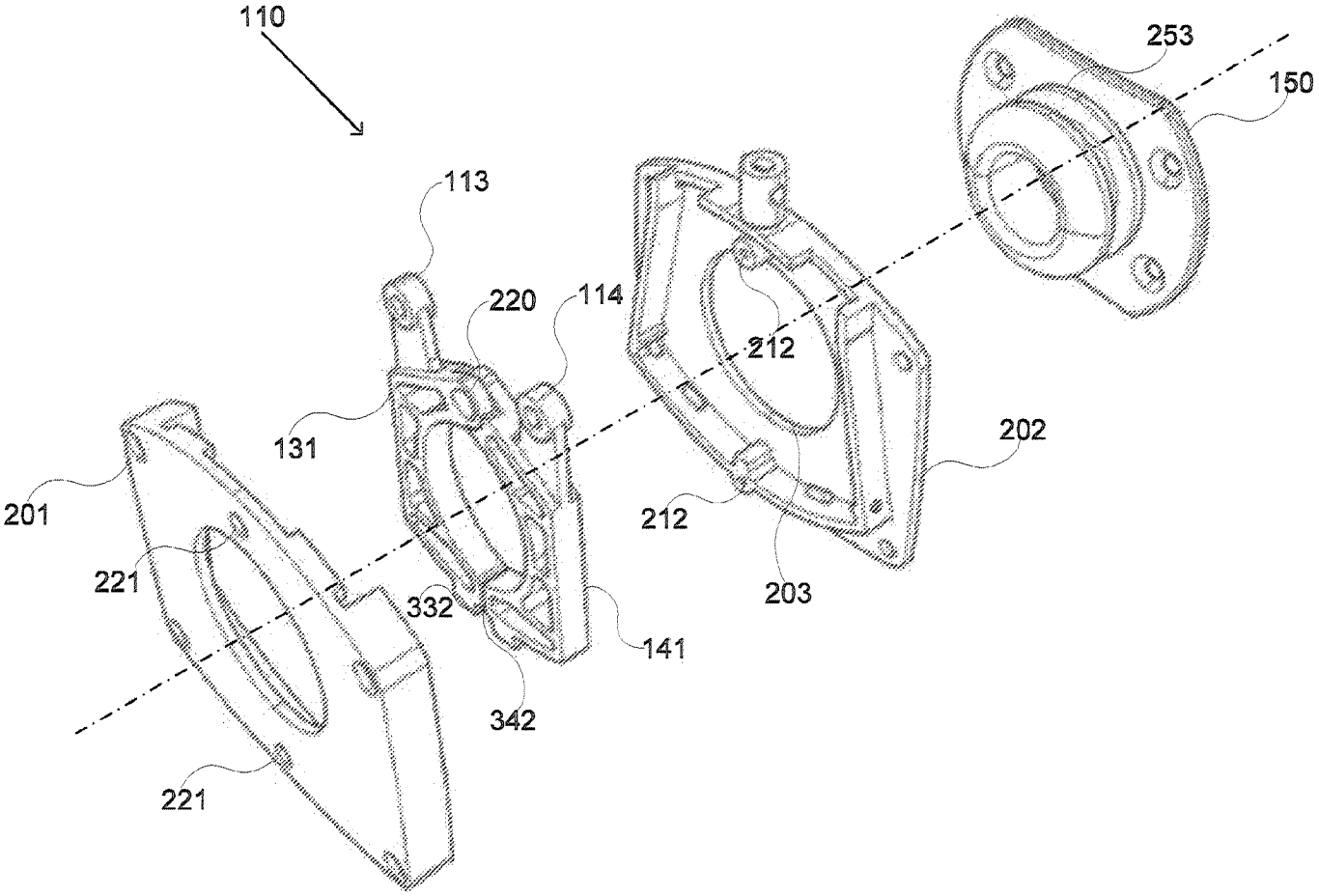
FIG. 2 shows the buckle male and an assembly breakdown of the buckle, in accordance with some exemplary embodiments of the disclosed subject matter.

Referring now to FIG. 2, showing buckle male 150 and an assembly breakdown of buckle 100, in accordance with some exemplary embodiments of the disclosed subject matter. In some exemplary embodiments buckle 110 may comprise a buckle front cover 201, a buckle rear cover 202, a $1^{st}$ latch 131 and a $2^{nd}$ latch 141, wherein the $1^{st}$ latch 131 and the $2^{nd}$ latch 141 are linked together by latches spindle 220. Additionally, latches spindle 220 may comprise a spring (not shown), configured to cause $1^{st}$ lip 332 and $2^{nd}$ lip 342 kiss each other, practically defining the close position of both latches.

It shall be noted that in some exemplary embodiments, $1^{st}$ latch lever 113 and $1^{st}$ lip 132 may be an integral part of $1^{st}$ latch 131. Likewise, $2^{nd}$ latch lever 114 and $2^{nd}$ lip 142 may be an integral part of $2^{nd}$ latch 141. It shall also be noted that pressing $1^{st}$ latch lever 113 and, $2^{nd}$ latch lever 114 toward each other will cause the both latches to spread away from each other (open position), wherein the pressing force should overcome the spring load. It shall also be noted that that the term latches assembly refer in the present disclosed subject matter to the $1^{st}$ latch 131, the $2^{nd}$ latch 141, latches spindle 220 and the spring.

In some exemplary embodiments, latches assembly, front cove 201 and rear cover 202 may be assembled to form the buckle 110. The assembly may be carried out by driving two screws through holes 221 (of front cove 201) into thread holes 212 (of rear cove 202), wherein latches assembly is sandwiched between the two covers.

It shall be noted that when buckle 110 and buckle male 150 are connected, as described previously, the gravity force of the load of which the load buckle male 150 is connected to, may be distributed on the shoulder straps and a fastening connector of the disclosed subject matter. Such forces together with movement impacts, originated by the carrier, may cause buckle bolt 155 to apply shear stress that potentially can damage the latches. To avoid that, the buckle male 150 is provided with a circular barrier 253 that acts as a buffer that evenly distribute the kinetic energy of the load around aperture 203 of rear cove 202, without damaging the latches assembly.

Figure 3B:
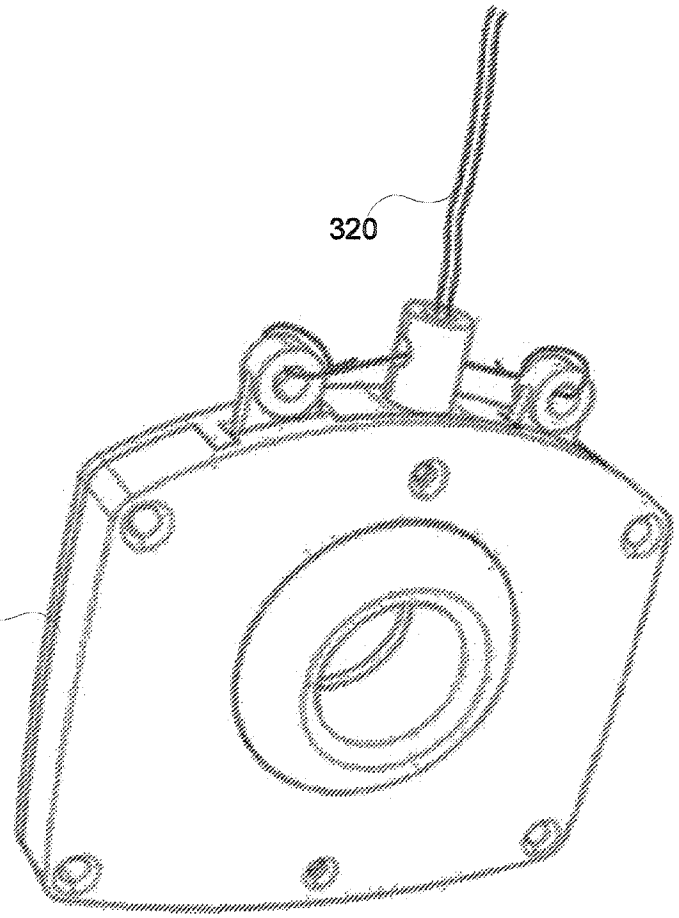
FIG. 3B illustrates a perspective view of the buckle male locked into the buckle with a release cord, in accordance with some exemplary embodiments of the disclosed subject matter.
Figure 3A:
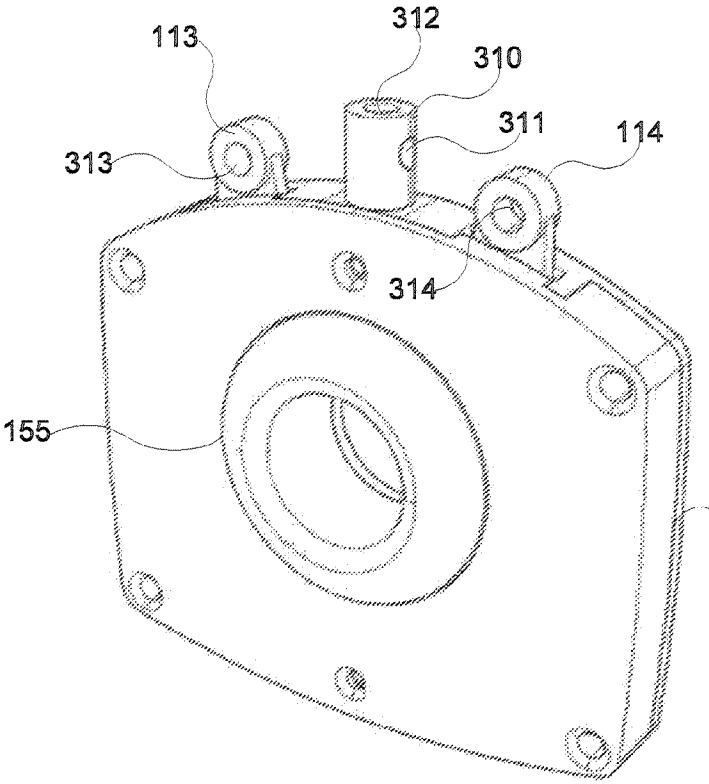
FIG. 3A illustrates a perspective view of the buckle male locked into the buckle, in accordance with some exemplary embodiments of the disclosed subject matter.

Referring now to FIGS. 3A and 3B, both illustrating a perspective view of the buckle male 150 locked into the buckle 110, wherein FIG. 3B also illustrate a release cord 320, in accordance with some exemplary embodiments of the disclosed subject matter.

In some exemplary embodiments, pressing $1^{st}$ latch lever 113 and, $2^{nd}$ latch lever 114 toward each other will cause both latches to spread open. Thus, enabling buckle bolt 155 to slip out of buckle 110 (i.e. releasing the load). Additionally or alternatively, releasing the load (i.e. disconnecting the buckle male 150 from buckle 110) may be done by pulling release cord 320 with one hand. In some exemplary embodiments, both ends of cord 220 may be hitched through hole 312 of cord guide 310, then each cord end oppositely exits cord inlet 311 toward $1^{st}$ latch lever 113 and $2^{nd}$ latch lever 114 respectively. At last through-hole 313 and through-hole 314 may be utilized for tying both end of the cord 320 respectively, as depicted in FIG. 3B.

In some exemplary embodiments, cord 320 may be pulled by a carrier in order to quickly release a load typically mounted on his/her back. Pulling cord 320 will cause both latches to spread and let buckle bolt 155 slip out of buckle 110. In some exemplary embodiments the fastening connector of the disclosed subject matter, may be utilized for connecting the carrier in a towing mode, such as towing a cart or a sled. In such embodiments buckle bolt 155 and buckle 110 are the only link between the carrier and the load, thus by pulling cord 320, with one hand, is all that takes for alleviating the carrier from the load.

It will be noted that the round shape of buckle bolt 155 allows it to freely rotate, around axis 100, inside buckle 110. Thus, preventing torques from impacting the carrier's balance while in motion. In some exemplary embodiments buckle bolt 155 may comprise stoppers (not shown) that may limit the rotation of buckle male 150 inside buckle 110. Such limitation may be needed in order to prevent a full rotation of the buckle bolt 155 inside buckle 110, which may result in flipping the load upside down. In some exemplary embodiments, the stoppers may limit the rotation (left and right of the standing carrier) to about 40 degrees to each side, i.e., +/−15 degrees, +/−20 degrees, +/−25 degrees, +/−30 degrees, ±40 degrees, a combination thereof, or the like.

In accordance with another aspect, a carrier system is disclosed that comprises a carrier provided with an integral buckle and a plurality of loads, each provided with an integral buckle male. The buckle and the buckle male constitute a connector that connects the carrier to one of the loads at a time. A carrier wearing the carrier can swiftly replace the loads by connecting and disconnecting the connector.

Figure 4A:
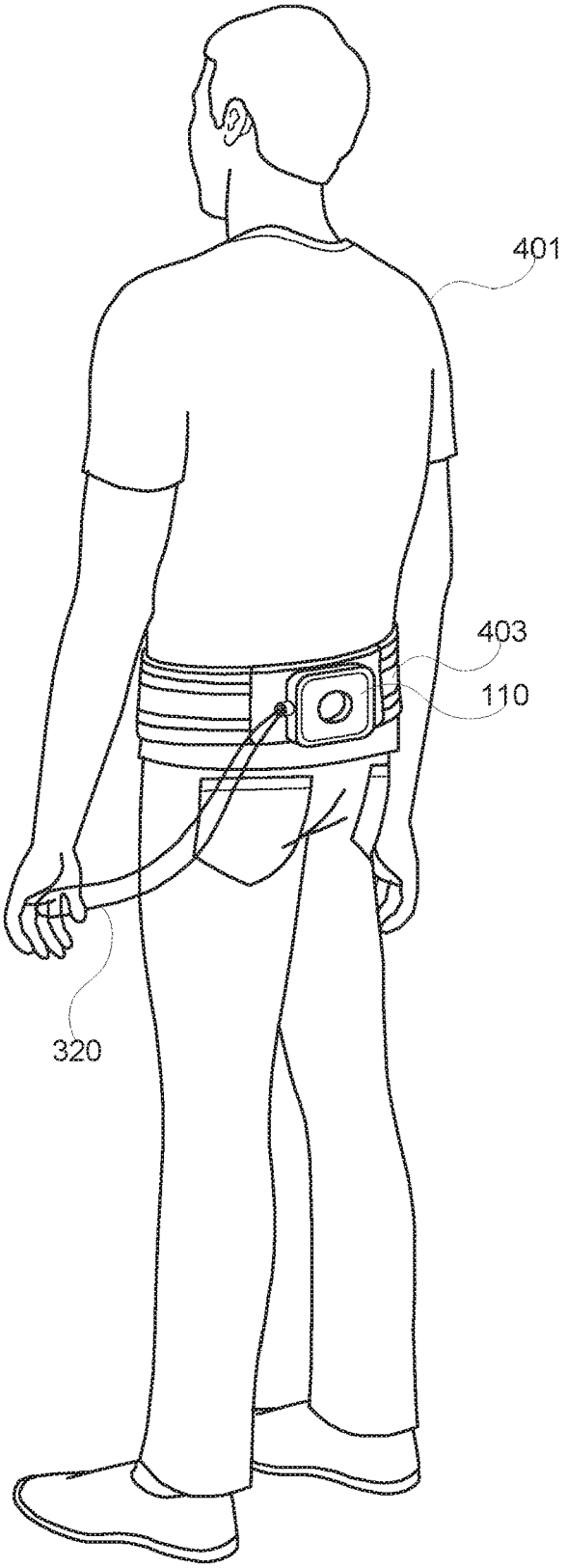
FIG. 4A illustrates a carrier wearing a belt connected to a load in accordance with some exemplary embodiments of the disclosed subject matter.

Reference is now made to FIG. 4A illustrates a carrier 401 wearing a belt 403 connected to a load 402, in accordance with some exemplary embodiments of the disclosed subject matter.

Figure 4B:
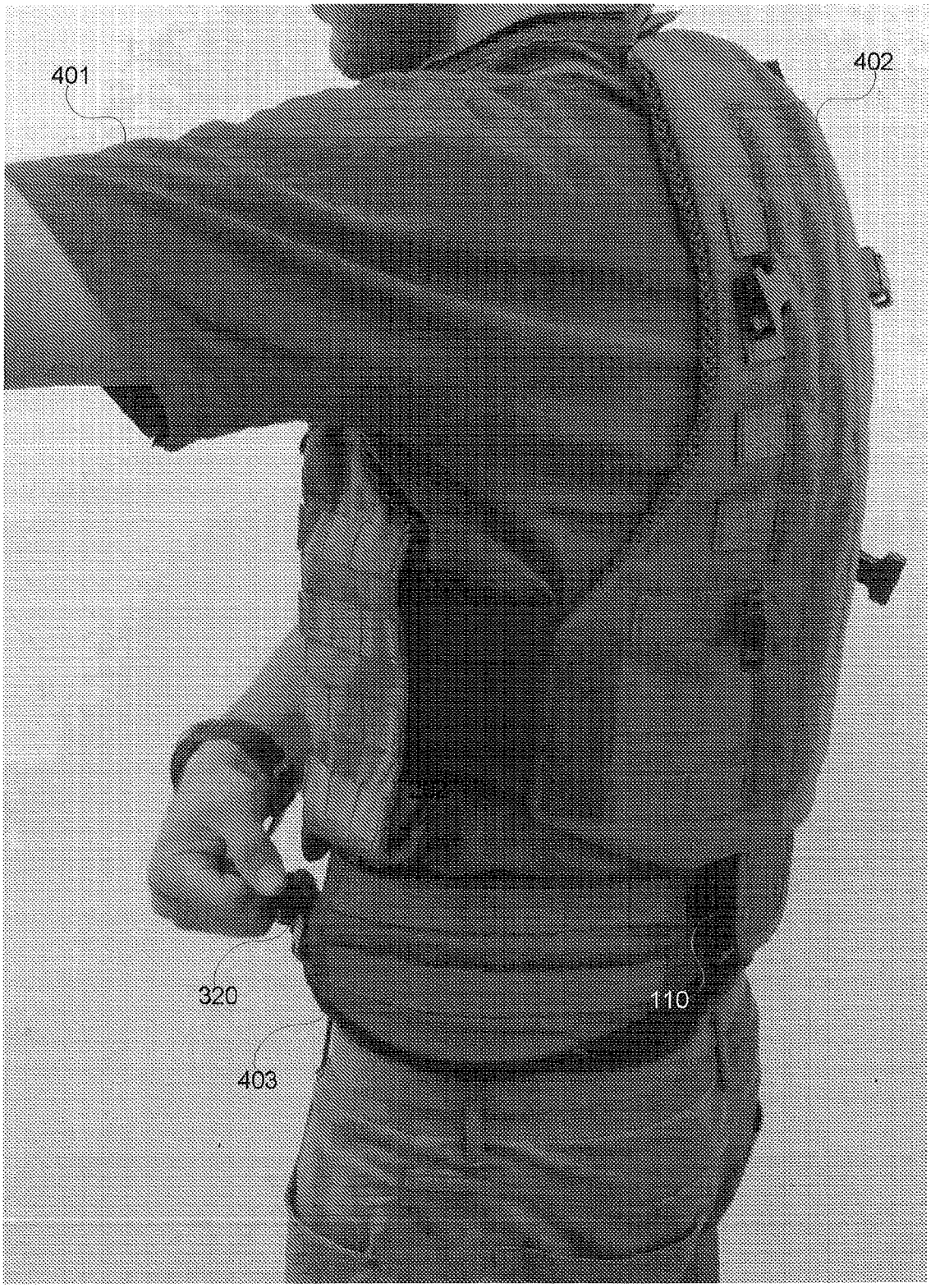
FIG. 4B illustrates the carrier dismantling the load shown in FIG. 4A, by pulling the release cord, in accordance with some exemplary embodiments of the disclosed subject matter.

Reference is now made to FIG. 4B illustrates the carrier 401 dismantling the load 402 (of FIG. 4A), by pulling the release cord 320, in accordance with some exemplary embodiments of the disclosed subject matter.

Figure 4C:
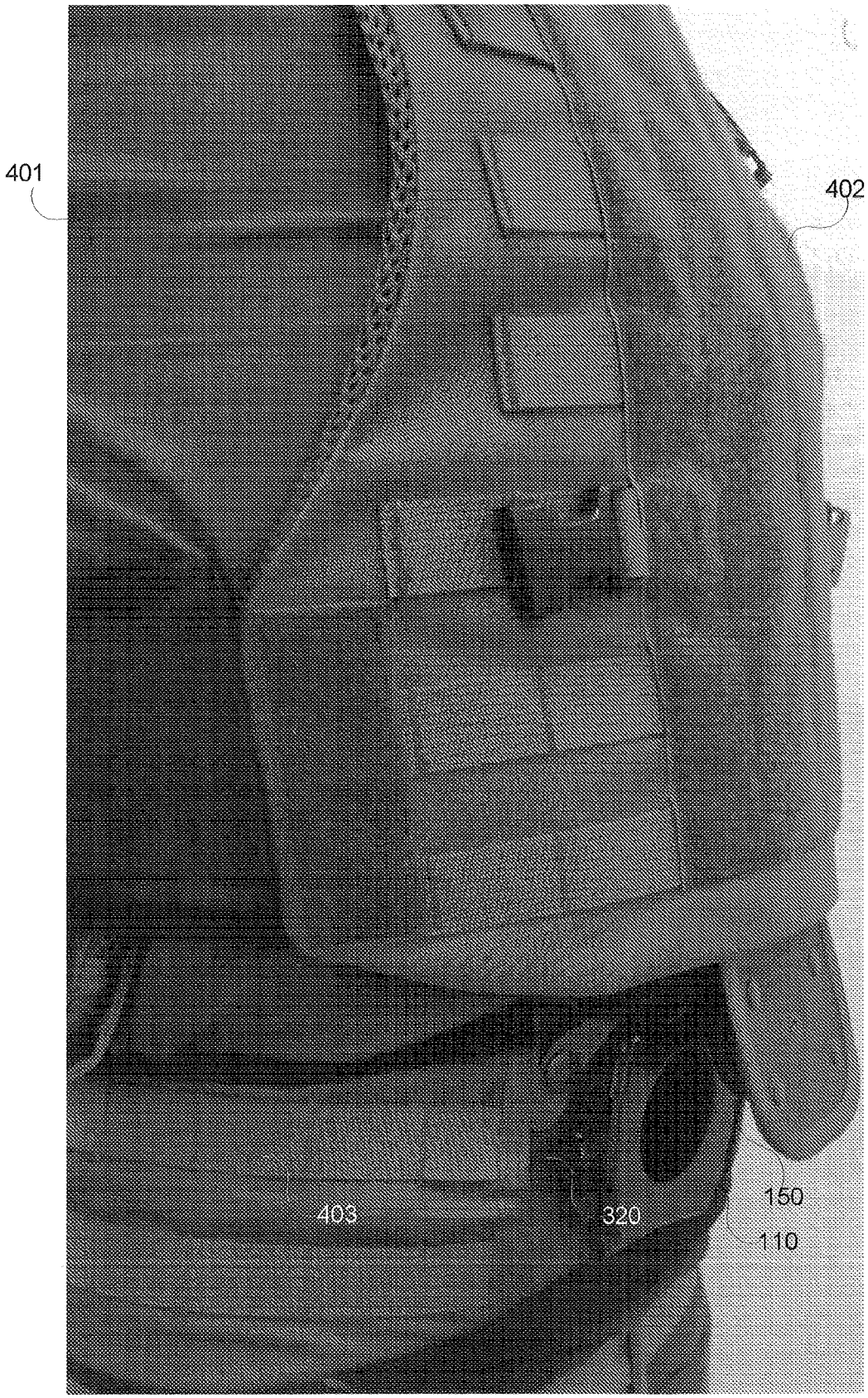
FIG. 4C illustrates the buckle male of the load disconnected from the buckle of the belt, in accordance with some exemplary embodiments of the disclosed subject matter.

Reference is now made to FIG. 4C illustrates the buckle male 150 of the load 402 disconnected from the buckle 110 of the belt 403, in accordance with some exemplary embodiments of the disclosed subject matter.

Figure 4D:
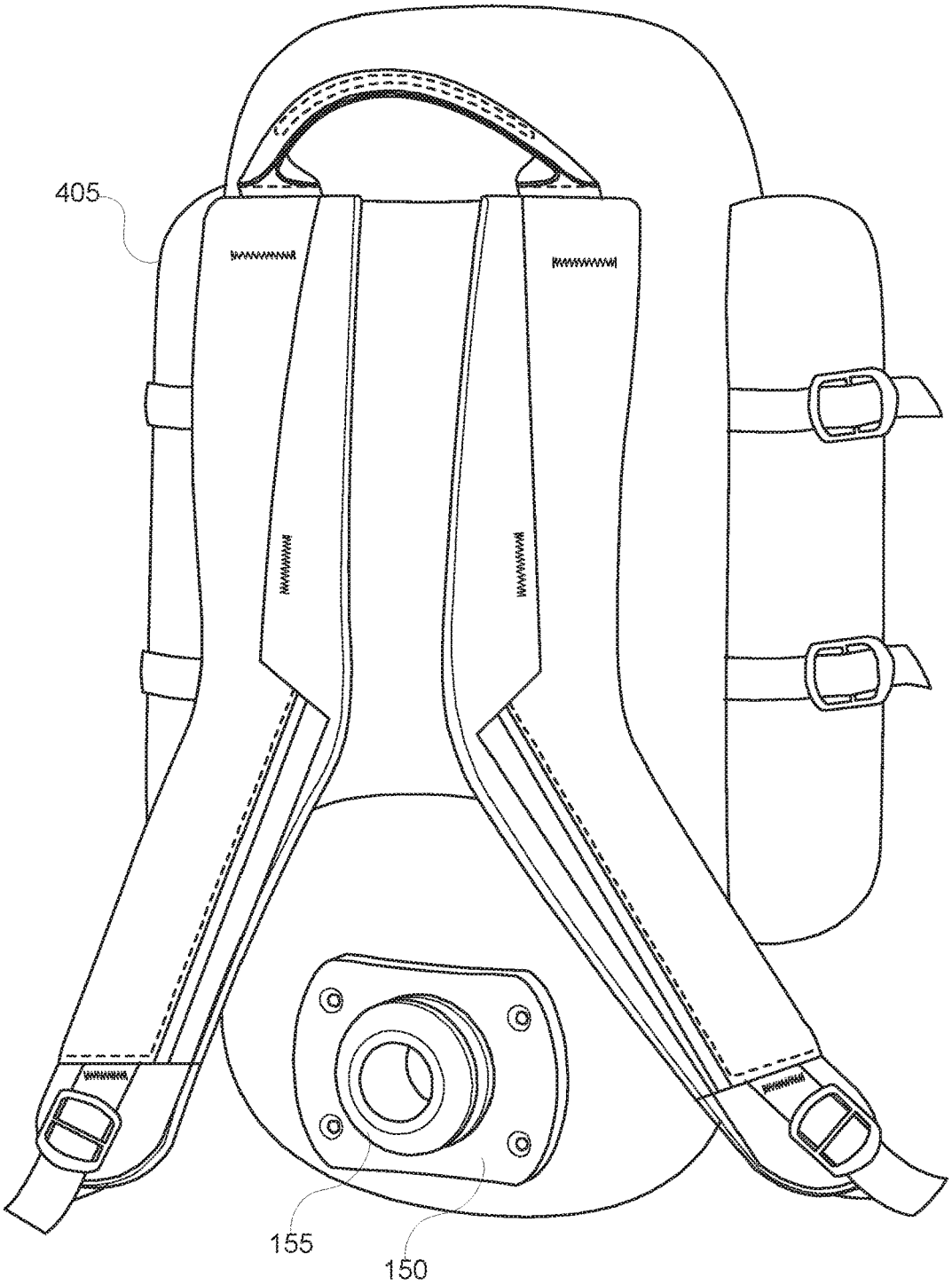
FIG. 4D illustrates another load provided with a buckle male, in accordance with some exemplary embodiments of the disclosed subject matter.

Reference is now made to FIG. 4D illustrates load 405 provided with a buckle male 150, in accordance with some exemplary embodiments of the disclosed subject matter.

Figure 4E:
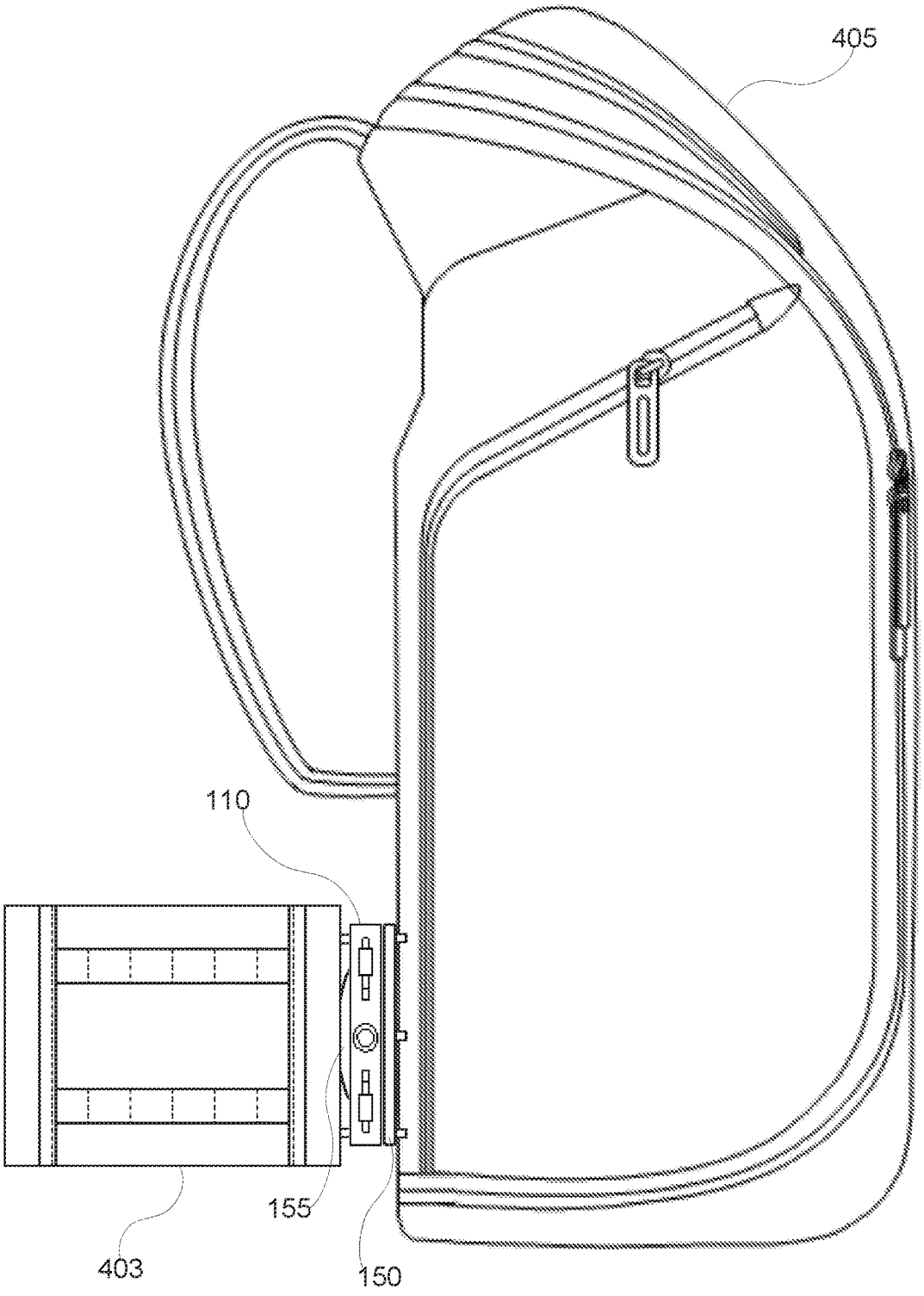
FIG. 4E illustrates the carrier wearing the load shown in FIG. 4D, in accordance with some exemplary embodiments of the disclosed subject matter.

Reference is now made to FIG. 4E illustrates the carrier 401 carrying the load 405, in accordance with some exemplary embodiments of the disclosed subject matter.

Figure 4F:
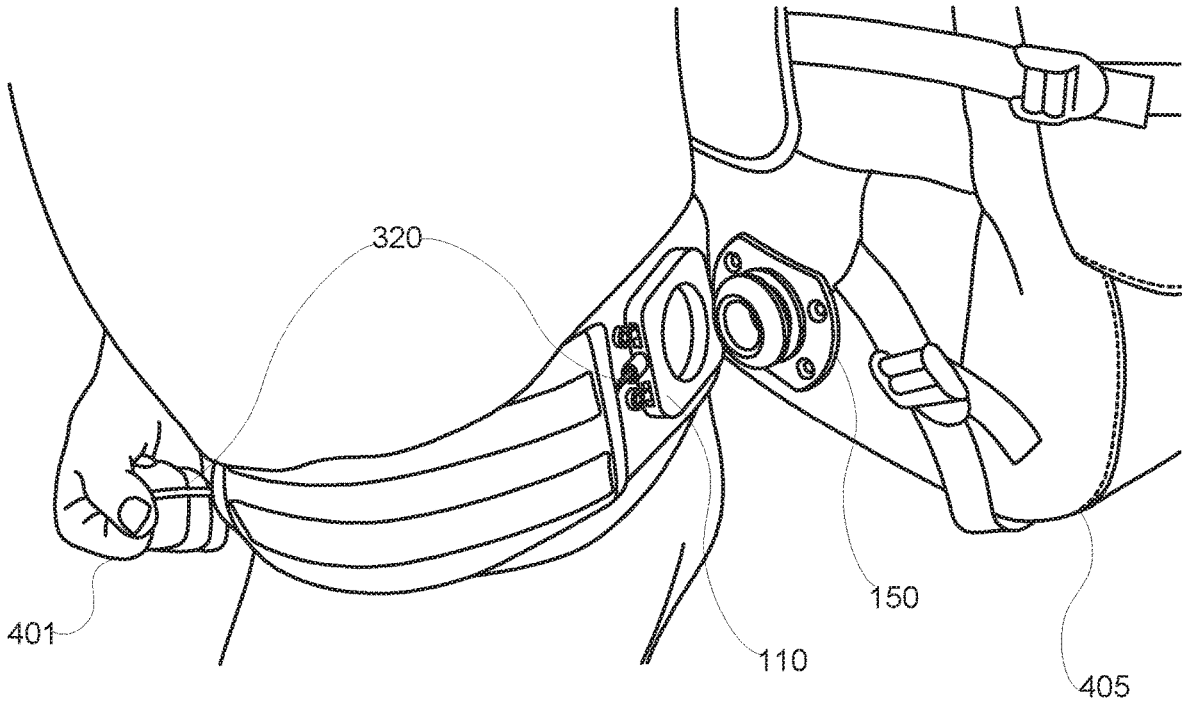
FIG. 4F illustrates the carrier pulling the release cord with one hand for dismantling the load, in accordance with some exemplary embodiments of the disclosed subject matter.

Reference is now made to FIG. 4F illustrates the carrier 401 pulling the release cord 320 with one hand for dismantling the load 405, in accordance with some exemplary embodiments of the disclosed subject matter.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A connector for swift fastening and dismantling a load to or from, respectively, a belt worn by a carrier, the connector comprising:

a buckle male having a bolt with a circumferential groove;

a buckle provided with two half circle latches linked together by a spindle and encircling a corresponding receptacle, wherein the buckle is configured to receive the buckle male therebetween while the two half circle latches are positioned within the groove;

two latch levers, each provided on one of the two half circle latches;

a single release cord provided to the buckle and connected to the two latch levers so that when the two latch levers are pressed towards each other by the single cord, the two half circle latches spread away from the groove, wherein the buckle male and the buckle are connected when the buckle male is pushed against and to within the receptacle between the two half circle latches for swiftly fastening the load to the belt, and are disconnected by pulling the single release cord using one hand of the carrier for swiftly dismantling the load off the belt.

2. The connector of claim 1, wherein the load is selected from the group consisting of a backpack; a rucksack; a cart; and a sled.

3. The connector of claim 1, wherein the buckle male is assembled to a load and the buckle is assembled to the belt.

4. The connector of claim 1, wherein the belt is selected from the group consisting of a lumbar-belt; a tac-vest; a back-belt; a weightlifting-belt; and a firefighters-belt.

5. The connector of claim 1, wherein the buckle is assembled to the load and the buckle male is assembled to the belt.

6. The connector of claim 1, wherein the two half circle latches are configured to completely enter the groove and grasp the buckle male so as to establish a firm connection.

7. The connector of claim 6, wherein the single release cord is connected to the two half circle latches to enable swift dismantling of the load by pulling the single release cord that consequently causes the latches to completely egress the groove, thus releasing the firm connection.

8. The connector of claim 1, wherein the buckle male is configured to freely rotate inside the buckle, and wherein the rotation allows the load to sway about the belt.

9. The connector of claim 1, wherein the buckle male further comprises a circular barrier.

10. The connector of claim 1, wherein the buckle male is provided with a bolt and the buckle is provided with a corresponding receptacle and wherein connection between the buckle and the buckle male is established by driving the bolt into the receptacle.

11. The connector of claim 1, wherein the bolt and the receptacle are rounded.

* * * * *